US007647744B2

(12) United States Patent
Payne, Jr.

(10) Patent No.: US 7,647,744 B2
(45) Date of Patent: Jan. 19, 2010

(54) ACOUSTIC ISOLATOR CLIP FOR ISOLATING WALLBOARD SUPPORT CHANNELS FROM FRAME MEMBER

(75) Inventor: Stephen W. Payne, Jr., Grayslake, IL (US)

(73) Assignee: United States Gypsum Company, Chicago, IL (US)

( * ) Notice: Subject to any disclaimer, the term of this patent is extended or adjusted under 35 U.S.C. 154(b) by 161 days.

(21) Appl. No.: 11/584,070

(22) Filed: Oct. 20, 2006

(65) Prior Publication Data

US 2008/0092458 A1 Apr. 24, 2008

(51) Int. Cl.
*E04B 1/38* (2006.01)

(52) U.S. Cl. ..... 52/770; 52/355; 52/357; 52/506.06; 52/512; 248/611; 24/458; 411/970

(58) Field of Classification Search ..... 52/235, 52/355–356, 357, 770, 285.3, 288.1, 512, 52/506, 800.18, 506.06; 248/74.2, 611, 634, 248/635; 24/19, 67.5, 275, 17 AP, 69 FP, 24/68 PP, 458, 290; 16/205; 411/522, 523, 411/970

See application file for complete search history.

(56) References Cited

U.S. PATENT DOCUMENTS 868,082 A * 10/1907 Freschl ..... 24/649
1,137,773 A * 5/1915 Marsden ..... 362/652
1,778,992 A * 10/1930 Wulfert ..... 248/635
1,870,112 A * 8/1932 Hand et al. ..... 24/275
2,258,342 A * 10/1941 Tinnerman ..... 411/112
2,320,308 A * 5/1943 Silverman ..... 16/87.2
2,351,725 A 6/1944 Wack
2,544,074 A * 3/1951 Ernst et al. ..... 220/9.2
2,716,434 A * 8/1955 Crowther ..... 411/106
2,904,820 A * 9/1959 Flora ..... 16/86 A
2,918,239 A * 12/1959 Wirth ..... 248/55
3,118,480 A * 1/1964 Kreider ..... 411/173
3,118,644 A * 1/1964 Wernig ..... 248/73
3,123,880 A * 3/1964 Barry et al. ..... 411/352
3,144,695 A * 8/1964 Budwig ..... 248/60
3,145,753 A * 8/1964 Kreider ..... 411/112
3,223,374 A * 12/1965 Butler et al. ..... 267/141.4
3,328,854 A * 7/1967 Tombari ..... 16/2.1
3,352,195 A * 11/1967 Fisher ..... 411/15
3,606,218 A * 9/1971 Enlund et al. ..... 248/74.2
3,716,613 A * 2/1973 Lux ..... 264/254
3,757,283 A * 9/1973 Kelly ..... 439/726
3,815,309 A * 6/1974 Olsen ..... 52/506.08
3,999,583 A * 12/1976 Nelson ..... 411/182
4,021,989 A * 5/1977 Hala ..... 52/713

(Continued)

*Primary Examiner*—Phi Dieu Tran A
(74) *Attorney, Agent, or Firm*—Greer, Burns & Crain, Ltd.; David Janci, Esq.; Pradip Sahu, Esq.

(57) ABSTRACT

A clip for use in acoustically isolating a wallboard support channel from a frame member, the support channel having at least one mounting point, includes a first portion positionable between a first surface of the channel and the frame member, a second portion positionable in contact with a second, opposite surface of the channel, and a bracket connecting said first and second portions. The first and second portions and the bracket each have at least one fastener opening in registry with corresponding openings on the other of the first and second portions such that a fastener passing through the openings and the mounting point is acoustically isolated from the bracket and from the channel.

5 Claims, 2 Drawing Sheets

U.S. PATENT DOCUMENTS 4,074,491 A * 2/1978 Bell et al. ..... 52/394
4,219,064 A * 8/1980 Lozano ..... 411/103
4,286,642 A 9/1981 Keatley
4,396,326 A * 8/1983 McKinnie et al. ..... 411/103
4,435,937 A * 3/1984 Stone ..... 52/520
4,442,647 A 4/1984 Olsen
4,577,450 A * 3/1986 Large ..... 52/787.12
4,996,752 A * 3/1991 Clendinen ..... 24/464
5,138,809 A * 8/1992 Saikachi ..... 52/235
5,409,283 A 4/1995 Ban
5,876,024 A 3/1999 Hain
6,287,064 B1 * 9/2001 Jhumra et al. ..... 411/175
6,371,283 B1 * 4/2002 Manchester ..... 198/816
6,474,917 B2 * 11/2002 Gauron ..... 411/112
6,854,941 B2 * 2/2005 Csik ..... 411/112
6,874,288 B1 * 4/2005 Washa et al. ..... 52/371
7,017,891 B2 3/2006 Izabel
7,120,970 B2 * 10/2006 Thomson et al. ..... 24/67.5
2008/0008345 A1 1/2008 Donaldson

* cited by examiner

ACOUSTIC ISOLATOR CLIP FOR ISOLATING WALLBOARD SUPPORT CHANNELS FROM FRAME MEMBER

BACKGROUND

This invention relates generally to isolation fasteners used to acoustically isolate items from sources of vibrations, and more particularly to such fasteners used for acoustically isolating wallboard panels from adjacent sound sources, such as nearby living spaces.

A significant issue in housing construction and in multi-family housing construction in particular, is the acoustical isolation between rooms and living units both horizontally and vertically adjacent. Currently, a variety of resilient channels and other sorts of isolation clips are used with varying degrees of cost and effectiveness. It is known to provide a resilient, formed metal channel fastened to a frame member such as wall supports (studs) or floor joists, and to then secure wallboard panels to the channel to isolate the wallboard from the underlying supports. In this scenario, sound transmission through the supports or joists is disrupted, and the space enclosed by the wallboard is somewhat insulated from outside noise. One source of such channels is CEMCO, City of Industry, Ca. with the channel sold as RC-1 Resilient Channel. However, in some applications, the use of RC-1 type resilient channel has not provided the desired level of acoustical isolation.

It is also known to provide a clip for use in suspending the RC-1 channel from the underlying supports or joists. More specifically, an RSIC sound isolation clip is produced by PAC International, Inc. (www.pac-intl.com). RSIC clips include a metal bracket provided with a cylindrical resilient pad with a plurality of integral resilient standoffs for engaging the frame member, typically a floor joist or a vertical wall stud. Opposite the pad, the bracket is connected to each leg of a generally "U"-shaped or "hat" channel which defines a space between the pad and the wallboard panel which is secured to the channel. The pad provides the acoustical isolation between the frame member and the wallboard panel.

One drawback of these clips is their relatively high cost, which can approach several dollars each. In addition, the RSIC clip system described above involves a relatively rigid attachment system of the wallboard panel to the frame member. Under the general principles of sound transmission, such rigid attachment generally correlates to a more efficient transmission of sound energy. Thus, such known clip systems are relatively costly for the amount of sound isolation provided.

Sound rated floors are typically evaluated by ASTM Standard #E492 and are rated as to Impact Insulation Class (IIC). The greater the IIC rating, the less impact noise will be transmitted to the area below in the case of floors. Floors may also be rated as to Sound Transmission Class (STC) per ASTM E90. The greater the STC rating, the less airborne sound will be transmitted to the area below. Desired IIC ratings for such wallboard systems are at least 50 and most preferably approaching 60.

Another factor in conventional sound insulation systems is the amount of instruction required for proper installation. Conventional clip systems are relatively complicated and when improperly installed, the desired levels of sound insulation are not achieved.

Thus, there is a need for an improved system for reducing acoustical transmission of wallboard panels, preferably exceeding the IIC rating of currently available systems. There is also a need for such an improved system which is compatible with conventional channels such as resilient channels.

There is also a need for an improved clip for such a system which is relatively inexpensive and relatively easy to install.

BRIEF DESCRIPTION OF THE INVENTION

The above-listed objects are met or exceeded by the present acoustic isolator clip for supporting wallboard channels relative to a frame member (floor joists, vertical studs or similar framing member) in which a U-shaped clip connects two soft, rubber-like bushings or grommets. Each bushing has a hole for receiving a fastener passing through the holes and through an attachment edge of a resilient wallboard panel support channel for securing the channel to a frame member. By properly decoupling the wallboard from the frame member, the IIC rating of the system can be improved in the range of 3-5 points. Also, it is believed that the preferred embodiment does not compromise the fire retardant characteristics of the wallboard system.

More specifically, a system for acoustically isolating a wallboard support channel from a frame member includes a clip and a support channel having at least one mounting point. The clip includes a first portion positionable between a first surface of the channel and the frame member, a second portion positionable in contact with a second, opposite surface of the channel, and a bracket connecting said first and second portions. The first and second portions and the bracket each have at least one fastener opening in registry with corresponding openings on the other of the first and second portions such that a fastener passing through the openings and the mounting point is acoustically isolated from the bracket and from the channel.

In another embodiment, a sound isolation assembly for use in acoustically isolating wallboard panels from an underlying frame member is provided and includes at least one elongate resilient channel having at least one attachment edge and at least one mounting point. A clip for use with the channel in acoustically isolating wallboard panels attached to the channel from the underlying frame member includes a first portion positionable between a first surface of the channel and the frame member, a second portion positionable in contact with a second, opposite surface of the channel, and a bracket connecting the first and second portions. A fastener with a head passes through the first and second portions and the mounting point. The first and second portions and the bracket each have at-least one fastener opening in registry with corresponding openings on the other of the first and second portions such that the fastener passing through the openings and the mounting point is acoustically isolated from the bracket and from the channel.

In still another embodiment, a clip is provided for use in acoustically isolating a wallboard support channel from a frame member, where the support channel has at least one mounting point. The clip includes a first portion positionable between a first surface of the channel and the frame member, a second portion positionable in contact with a second, opposite surface of the channel, and a bracket connecting the first and second portions. Each of the first and second portions includes a first annular formation disposed on an exterior of the bracket, and a second annular formation disposed on an interior of the bracket, the first annular formation has a diameter smaller than a diameter of the second annular formation.

The bracket is generally "U"-shaped with two legs and has open slots at an end of each leg for slidably receiving the first and second portions.

DETAILED DESCRIPTION OF THE INVENTION

Figure 1:
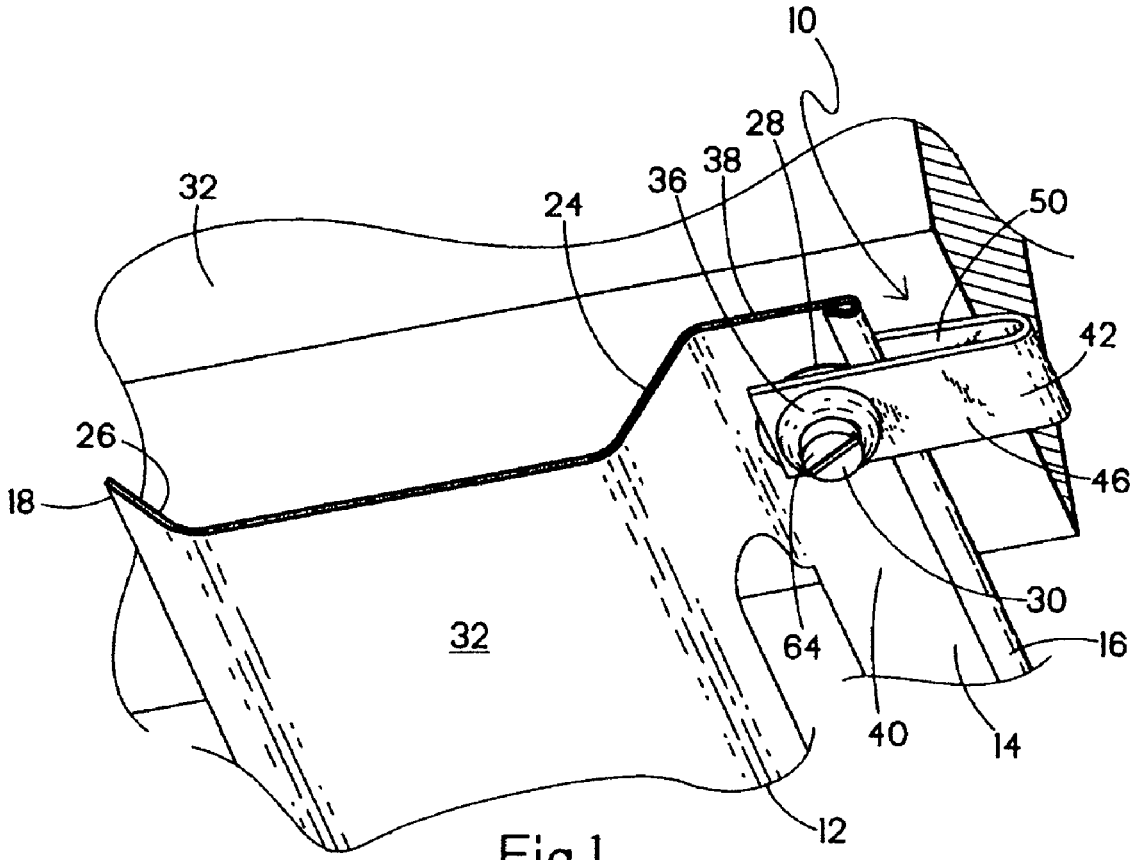
FIG. 1 is a top perspective view of an embodiment of the present clip, an associated resilient channel and a mounting fastener installed in a frame member.
Figure 2:
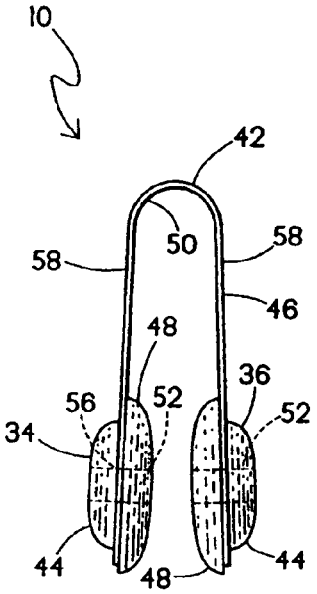
FIG. 2 is a top elevation view of the clip of FIG. 1.
Figure 3:
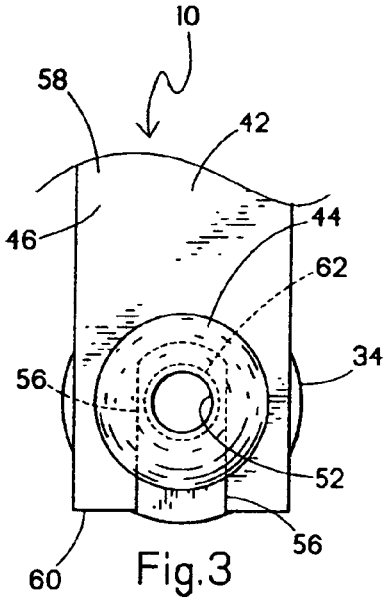
FIG. 3 is a fragmentary enlarged side elevation view of the clip of FIG. 2.
Figure 4:
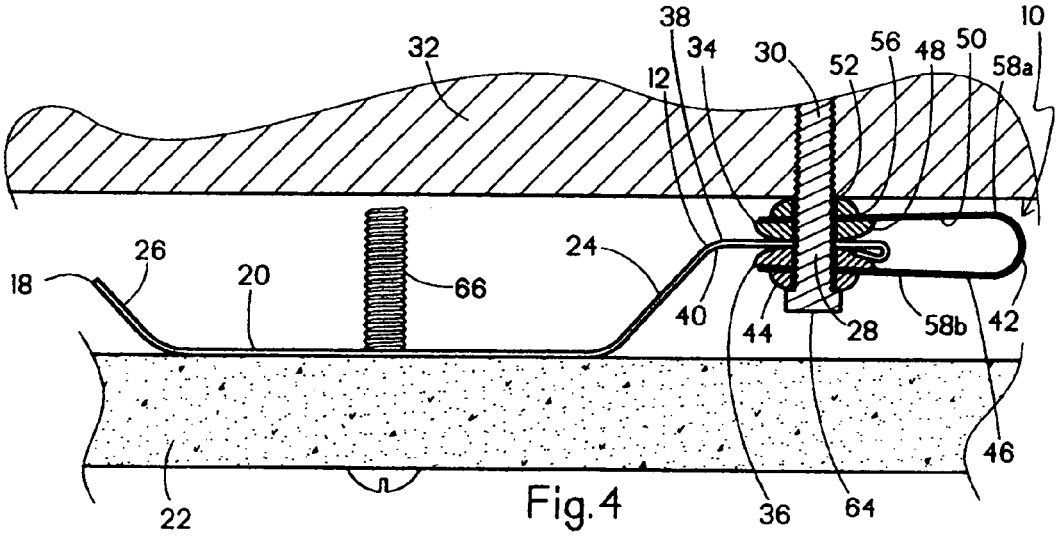
FIG. 4 is a side elevation of the present clip assembled with resilient channel to secure a wallboard panel to a frame member.

Referring now to FIG. 1, a clip for use in acoustically isolating a wallboard support channel from a frame member is generally designated 10. The clip 10 is shown secured to a fragment of resilient channel 12 of the type known as RC-1. Such channels are sold by CEMCO, City of Industry, Ca. as RC-1 Resilient Channel. While RC-1 type resilient channel (hereinafter resilient channel) is the preferred embodiment and is referred to in the present application, it will be understood that other comparable channels are suitable. The resilient channel 12 is fabricated from hot dipped galvanized steel complying with ASTM C-653 with a G40 coating meeting ASTM A-924 and meets Federal Specification QQ-S-775-D and ASTM-C-645. Manufacturing of the resilient channel 12 is accomplished by roll fanning the steel to a shape wit an attachment edge or flange 14, here shown with a rolled lip 16, an opposite free edge 18 and an interim long flat web 20 configured for attachment to a wallboard panel 22 (FIG. 4).

It will be seen that planes defined by the attachment edge 14 and the flat web 20 are displaced from, and generally parallel to each other by inclined panels 24, 26. Further, the attachment edge 14 is preferably provided with at least one mounting point 28 which is preferably a predrilled hole dimensioned for receiving a fastener 30. It will be appreciated that depending on the type of fastener 30, the mounting point 28 may be determined by the installer where the fastener is self tapping.

In the preferred embodiment, the fastener 30 is a threaded screw, and it will be understood that other types of screws or other fasteners are applicable here depending on the structure of a support frame member 32. In this application, "frame member" refers to a floor joist of wood or metal, a concrete beam or slab or the like, as well as a vertical stud made of wood or metal, or other frame members to which wallboard panels are typically attached as well known in the construction art. The resilient channel 12 partially acoustically isolates the wallboard panel 22 from the frame member 32 by providing an interim, cantilevered connection point which disrupts sound transmissions between the frame member and the wallboard panel.

Referring now to FIGS. 1-4, the clip 10 is preferably made of a pair of resilient, polymeric, rubber-like acoustically dampening bushings or grommets, referred to here as first and second portions 34, 36. The first portion 34 is positionable between a first or upper surface 38 of the channel 12 and the frame member 32. The second portion 36 is positionable in contact with a second, lower or opposite surface 40 of the channel 12. The portions 34, 36 are secured together in this sandwiching of the channel 12 by a generally "U"-shaped bracket 42. In the preferred embodiment, the bracket 42 is made of a metal strip or band which is formed into shape, however plastics or other self-supporting materials are considered suitable.

It is preferred that the first and second portions 34, 36 are identical, and as such only one will be described in detail. Each portion 34, 36 is generally ring-shaped and includes a first annular formation 44 disposed on an exterior surface 46 of the bracket 42, and a second annular formation 48 disposed on an interior surface 50 of the bracket. It is also preferred that the first annular formation 44 has a diameter distinct from, and preferably smaller than a diameter of the second annular formation 48. The portions 34, 36 are preferably integrally formed, as by molding or similar technology; however fabrication is also contemplated. A variety of rubber like materials are considered suitable for the portions 34, 36, including, materials which provide resiliency, and acoustic dampening and/or isolation. A typically preferred material is styrene butadiene having a Shore A Durometer value of 50.

At least one fastener opening 52 passes axially through both formations 44, 48 and accommodates the fastener 30. The fastener openings 52 of each of the formations 44, 48 are in registry with each other and with a corresponding aperture 56 in each leg 58 of the bracket 42. It is preferred that the aperture 56 is larger than the fastener openings 52 to avoid contact between the bracket and the fastener 30. Further, to facilitate assembly of the clip 10, it is also preferred that the aperture 56 be open near ends 60 of the legs 58, forming a slot.

Similarly, the portions 34, 36 each have an integrally formed groove or track 62 (shown hidden) dividing the first and second formations and defining a path for slidable engagement of the portions upon the corresponding bracket leg 58. The track 62 preferably extends around the periphery of the portion; however segmented tracks are also considered suitable. It is also contemplated that the apertures 56 could be closed, and in that case the portions 34, 36 would be axially inserted into the apertures of corresponding legs 58.

Referring now to FIG. 4, the main purpose of the bracket 42 is to maintain the portions 34, 36 in operational relationship with each other and to sandwich the attachment edge 14 between the second or inner annular formations 48. The larger diameter formations 48 enhance the acoustical isolation properties of the portions 34, 36. It will be seen that the first annular or outer formation 44 impacts the frame member 32 on an upper leg 58*a*, and is thus positioned between the upper or first surface 38 of the channel 12 and the frame member. Also, the outer formation 44 on the opposite or lower bracket leg 58*b* accommodates a head 64 of the fastener 30. Furthermore, the fastener 30, as it passes through the fastener openings 52 and the mounting point 28, is acoustically isolated from the channel 12.

Thus, installation of the present clip 10 is relatively simple compared to conventional clip systems such as the RSIC-clips. The installer merely places the clip 10 over the attachment edge 14 in registry with the mounting point 28. Next, the fastener 30 is inserted through the fastener openings and driven into the frame member 32.

Once the clip 10 is in place, the wallboard panel 22 is installed upon the flat web 20 of the channel 12 by at least one wallboard fastener 66. As is known in the art, the wallboard panel 22 is preferably gypsum wallboard; however other construction panels are contemplated, including but not limited to wood panels and mixtures of gypsum, fibers, rock wool, fiberglass and other construction grade panel materials known in the art.

Another feature of the present clip 10 is that the portions 34, 36 are of sufficient height or thickness measured along the axis of the fastener openings 52, that an end of most conventional fasteners used in wallboard installation such as the fastener 66 will not contact the frame member 32. Such contact is undesirable due to the acoustical "short circuiting" of the acoustical isolation system, in that sound waves could be transmitted to the wallboard panel directly through the fastener 66. Maintaining a separation of the fastener 66 from the frame member 32 avoids such contact and preserves the desired acoustical isolation.

Acoustical isolation is enhanced because the wallboard panel 22 is acoustically decoupled from the frame member 32. Also, the inherent resiliency of the channel 12 assists in dampening sound transmission between the frame member 32 and the wallboard panel 22. It has been found that use of the present clip 10 in flooring tests has resulted in an improvement of approximately 3 IIC points. Further, the improvement has been most noticeable at frequencies of approximately 1,000 Hz or higher, which is the range of human speech.

As indicated above, fire performance of such systems is a design consideration. In the present case, it is believed that in the event of a fire, the portions 34, 36 would melt away, but the physical connection between the fastener 30, the channel and the frame member 32 would remain, maintaining the structural integrity of the system.

While a particular embodiment of the present acoustic isolator clip for isolating wallboard support channels from a frame member has been shown and described, it will be appreciated by those skilled in the art that changes and modifications may be made thereto without departing from the invention in its broader aspects and as set forth in the following claims.

What is claimed is:

1. A sound isolation assembly for use in acoustically isolating wallboard panels from an underlying frame member, comprising:

at least one elongate resilient channel having at least one attachment edge and at least one mounting point;

a clip for use with said channel in acoustically isolating wallboard panels attached to said channel from the underlying frame member includes a bracket having a first leg and a second leg, each said leg being generally parallel to each other, and wherein each said leg has an interior surface and an exterior surface, said interior surfaces being opposite each other and generally parallel to said exterior surfaces, a first portion positionable on said first leg and between a first surface of the channel and the frame member, a second portion positionable on said second leg and in contact with a second, opposite surface of the channel;

wherein each said portion is positioned by slidingly engaging said corresponding leg;

wherein each said portion has a first formation disposed on said exterior surface of said corresponding leg and a second formation attached to said first portion and being disposed on said interior surface of said corresponding leg; and a fastener with a head passing through said first and second portions and said mounting point;

said first and second portions and said bracket each having at least one fastener opening in registry with corresponding openings on the other of said first and second portions, and said first and said second portions each being a resilient, acoustically dampening material such that said fastener passing through said openings and said mounting point is acoustically isolated from said bracket and from the channel.

2. The assembly of claim 1 wherein each of said formations is annular, and wherein each of said portions includes a track dividing said formations, said first formation constructed and arranged for accommodating said fastener head.

3. The assembly of claim 1 wherein said bracket is metal and has end portions accommodating said first and second portions.

4. The assembly of claim 3 wherein said bracket is generally "U" -shaped and has open slots at an end of each said leg for slidably receiving said first and second portions.

5. The assembly of claim 1 wherein each said first and second portions defines a track for accommodating an end of said bracket.

* * * * *